United States Patent [19]

Pyle

[11] 4,043,237

[45] Aug. 23, 1977

[54] GUARD FOR RADIAL ARM SAW

[75] Inventor: Stoddard H. Pyle, Corvallis, Oreg.

[73] Assignee: Wayne R. Roberts, Corvallis, Oreg. ; a part interest

[21] Appl. No.: 740,309

[22] Filed: Nov. 9, 1976

[51] Int. Cl.[2] ..... B27B 5/20; B27G 19/04

[52] U.S. Cl. ..... 83/478; 83/471.3; 83/546; 83/860

[58] Field of Search ..... 83/478, 471.3, 546, 83/860, 486.1, 814

[56] References Cited

U.S. PATENT DOCUMENTS

| | | | |
|---|---|---|---|
| 3,092,154 | 6/1963 | Dobslaw | 83/486.1 |
| 3,848,502 | 11/1974 | O'Neill | 83/814 |

*Primary Examiner*—Willie G. Abercrombie
*Attorney, Agent, or Firm*—D. Paul Weaver

[57] ABSTRACT

A preferably transparent awareness guard of flat plate form is attached to the conventional upper saw guard of a radial arm saw or the like in such a manner that the awareness guard can be raised and lowered relative to the work and saw blade and can also be tilted through a rather wide angular range and securely locked in various adjusted positions. The guard extends forwardly of the saw blade and on opposite sides thereof so that, when the sawyer moves material in front of the saw blade to reposition his work, his arm will engage the awareness guard before contacting the saw blade.

12 Claims, 7 Drawing Figures

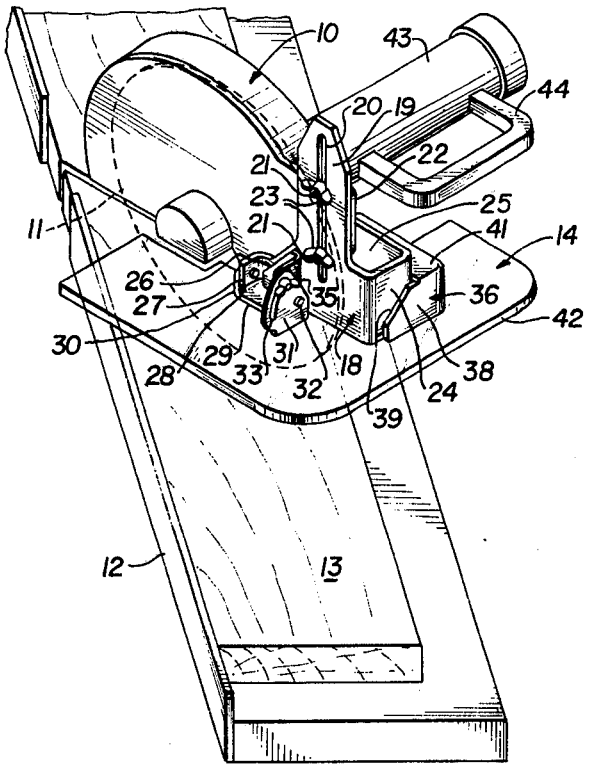
FIG. 1
FIG. 2
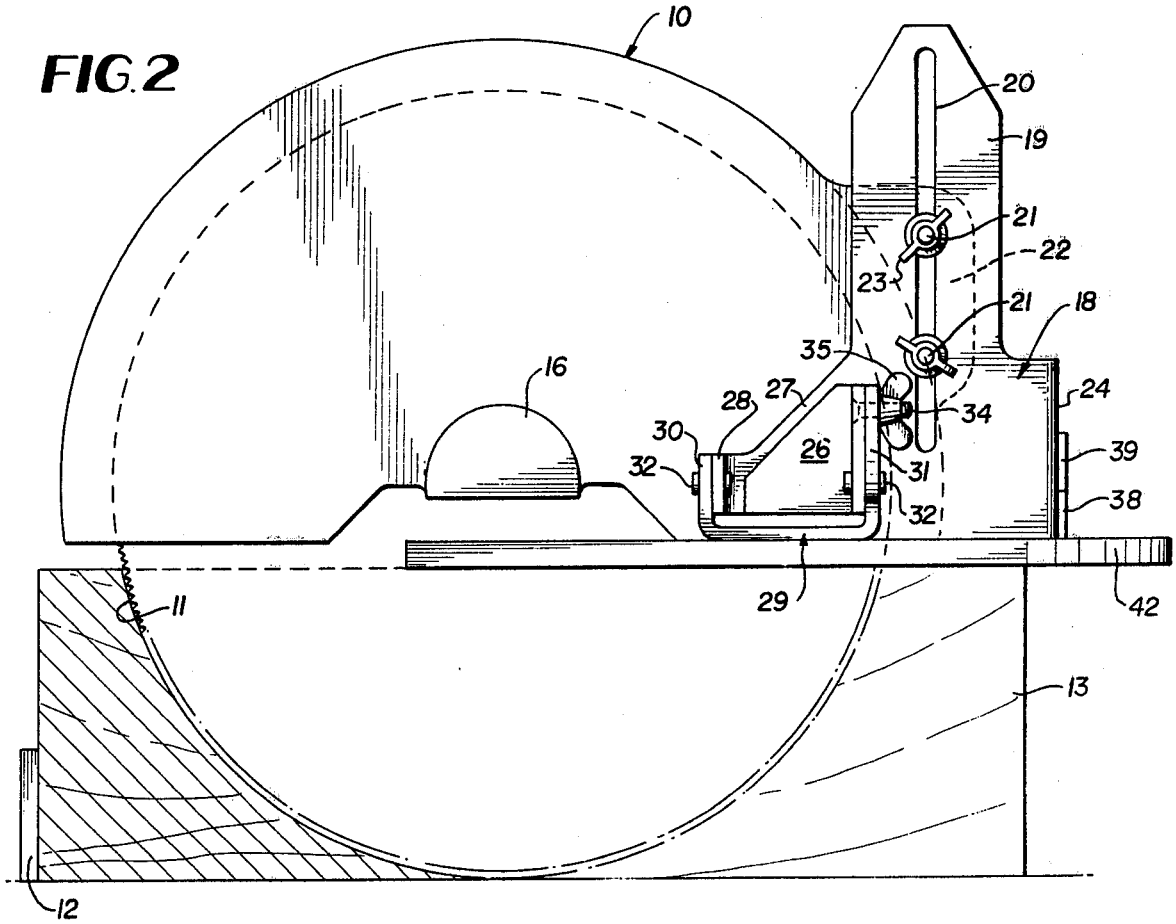

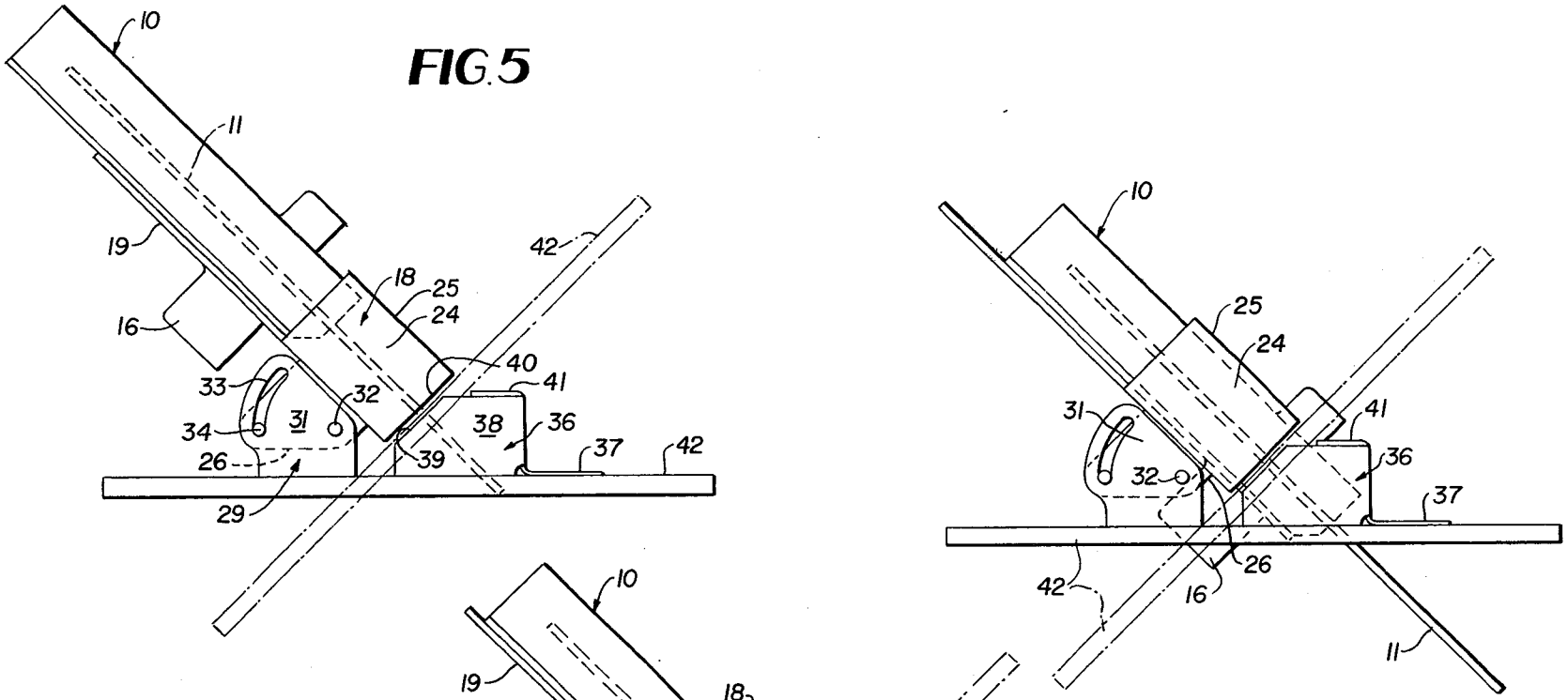
FIG. 5
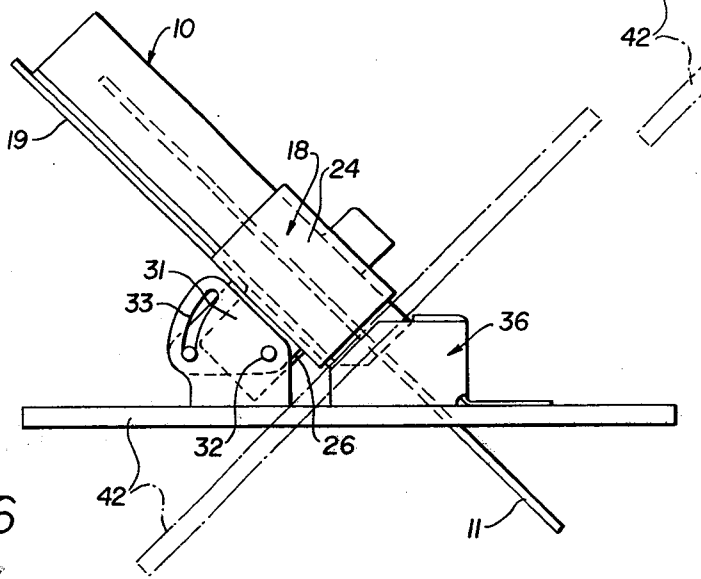
FIG. 6
FIG. 7

GUARD FOR RADIAL ARM SAW

BACKGROUND OF THE INVENTION

In recent years, some protection for users of radial arm saws has been attained by employing a lower guard section hinged in various ways to the usual upper saw guard. The lower guard section has been formed from semi-circular discs placed on either side of the saw blade or similar arrangements. With these protective devices in use when the saw blade is traveling at 90 degrees to the fence, the lower guard assembly is able to move with relative ease over the material being cut. Cutting components for wooden roof trusses and the like requires some angles to be cut where the saw blade approaches parallelism to the fence. In these situations, the hinged lower guard assembly tends to bind between the saw blade and fence and becomes a hazard to the sawyer as it diverts the sawyer's attention from the material being cut to the lower guard.

The objective of this invention is to provide an improved and safer guard for radial arm saws which employs a different approach to the problem and eliminates the above-discussed complications or difficulties.

Some examples of the patented prior art are U.S. Pat. Nos. 1,375,698; 2,487,396; 3,068,919 and 3,848,502.

Various features and advantages of the invention over the known prior art will become apparent to those skilled in the art during a reading of the following description.

BRIEF DESCRIPTION OF THE DRAWINGS

FIG. 1 is a perspective view of an awareness guard for a radial arm saw embodying the invention.

FIG. 2 is a side elevation thereof.

FIGS. 5, 6 and 7 are additional front elevational views of the invention in various adjusted positions relative to the saw blade.

DETAILED DESCRIPTION

Figure 4:
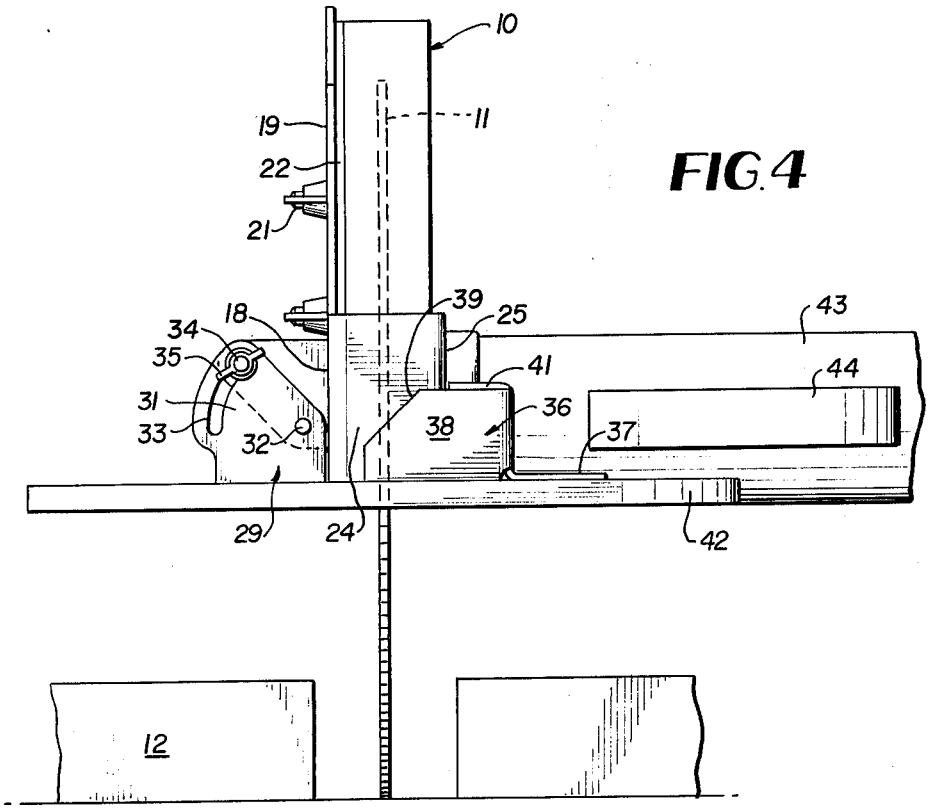
FIG. 4 is a front elevational view of the invention.

Referring to the drawings in detail wherein like numerals designate like parts, the numeral 10 designates the customary upper guard for the saw blade 11 of a conventional radial arm saw, the details of which form no part of this invention and are therefore omitted. The upper guard 10 and saw blade are illustrated in FIGS. 1, 2 and 4 in relation to a fixed fence 12 against which the workpiece 13 being cut is positioned by the sawyer, as illustrated.

Figure 3:
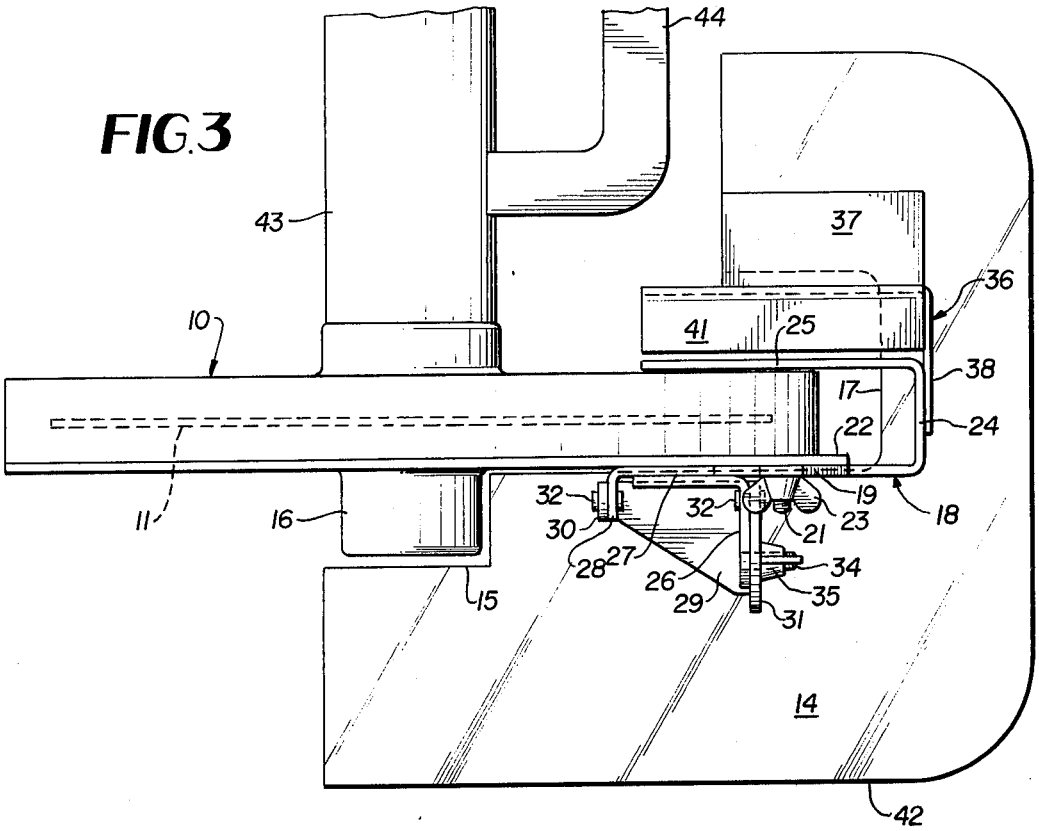
FIG. 3 is a plan view of the invention.

The awareness guard forming the essence of the invention is indicated in its entirety by the numeral 14 and consists of a flat plate body of transparent material having a perimeter edge 42 of generally U-configuration, as viewed in FIGS. 1 and 3. The perimeter edge 42 constitutes the actual awareness guard element to be contacted by the sawyer to alert him of nearness to the saw blade. As depicted in FIGS. 1 and 2, the awareness guard projects well forwardly of the saw blade 11 and approximately equidistantly on opposite sides of the blade. The area bounded by the guard edge 42 may, in some instances, be formed of screen or other gridwork or lattice construction to allow visual observation of the material being cut. The guard could be molded in its entirety including elements 14, 24, 36 and 38 as a unit of clear plastic material. The awareness guard 42 is notched at 15 to clear a hub extension 16 of the upper guard 10, and is additionally contoured at 17 to clear the front of the upper guard 10, FIG. 3. The upper guard 10 is attached to an arbor housing 43 and a saw pulling handle 44 is attached to the arbor housing. The awareness guard is cut away on one side, FIGS. 1 and 2, to accommodate the handle 44.

The awareness guard 42 is bodily carried by the mounting bracket 18 in a manner to be fully described but is not directly attached thereto. The mounting bracket 18 has a vertical extension 19 provided with an elongated vertical slot 20 through which the awareness guard is rendered vertically adjustable relative to the guard 10 and saw blade. The mounting bracket 18 is securely held in any selected vertically adjusted position by a pair of studs 21 projecting laterally from an extension 22 of the upper guard 10. These two studs are received through the slot 20, and wing nuts 23 on the threaded studs serve to releasably clamp the mounting bracket 18 to the upper guard 10 in the selected position of use.

The mounting bracket 18 has an integral front transparent transverse extension 24 leading to and carrying a reversely directed transparent plate extension 25 which laps the far side of the upper guard 10, FIG. 3, and forms a U-shaped shield on the forward side of the mounting bracket 18 immediately above the upper face of awareness guard 42. As will be further described, this forward shield carried by the mounting bracket 18 encloses the forward edge of the saw blade 11 when the mounting bracket and awareness guard 42 are adjusted downwardly on the guard 10, as shown in FIG. 5.

An L-shaped bracket 26 rigid with a rear extension 27 of bracket 18 and a small right angular extension 28 on the rear of extension 27 form the pivotal support for a U-shaped pivot or tilt bracket 29 which is directly and fixedly attached to the top face of awareness guard 42. The bracket elements 26 and 29 are pivotally connected by coaxial pivot elements 32 which engage through apertures in the sides 30 and 31 of bracket 29. The forward side 31 of the bracket 29 attached directly to the awareness guard has an arcuate slot 33 through which the awareness guard 42 is pivoted or tilted on the axes of elements 32 to an extent shown in FIG. 5, as when making saw cuts in a workpiece where the saw blade is at an angle thereto rather than perpendicular. A projecting threaded stud 34 on bracket 26 engages through the arcuate slot 33, and receives a clamping wing nut 35 on its forward end, whereby the awareness guard 42 may be tilted to the desired angular position relative to the upper guard 10 and may be releasably locked in such position. It may now be seen that the awareness guard 42 is connected with the mounting bracket 18 and carried bodily thereby through the guard attached bracket 29 which is tiltable or angularly adjustable on the mounting bracket 18.

The invention additionally comprises a transparent tilt shield 36 secured directly to the top of awareness guard 42 by a mounting flange 37. The tilt shield 36 has a front wall 38 which laps the shield portion 24 when the awareness guard is level, FIGS. 1 and 2. The front wall 38 has a diagonal edge 39 thereon, as shown. When the awareness guard 42 is tilted, FIGS. 5 to 7, the diagonal edge 39 can be parallel to the lower edge 40 of the upper guard 10 with a small gap, FIG. 5, and the front wall 38 of shield 36 will enclose that portion of the saw blade 11 which would otherwise be exposed below the upper guard 10 when the awareness guard is tilted. Thus, the shield 36 travels with the guard 42 to which it is directly attached and protects the sawyer in a region where the saw blade would otherwise be exposed and dangerous when the guard is tilted. The shield 36 additionally has a top wall 41 integral therewith which covers the space immediately outside of the extension 25 when the awareness guard is level, FIGS. 1 and 3. It is intended that the awareness guard be positioned immediately above the workpiece 13 to keep the distance between the guard and work table at a minimum. The drawings illustrate the ranges of vertical and angular adjustment of the invention.

It may now be seen that the invention provides safety for the hands or arms of the sawyer in situations of use which are commonly encountered with a radial arm saw. The upper guard 10 prevents contact with the top or sides of the saw blade 11 anywhere above the workpiece. The awareness guard 42, whether level or tilted, signals the sawyer that the saw blade is approaching his arm and the transparency of the guard 42 does not impede the sayer in his work by hiding the work. The extension shield 24 etc. on the mounting bracket 18 covers the gap below the upper guard 10 when the mounting bracket 18 is lowered relative to the upper guard, FIG. 5. the tilt shield 36 protects against contact with the saw blade 11 in the gap which develops below the upper guard 10 when the awareness guard is tilted, regardless of its elevation with the mounting bracket 18, as depicted in FIGS. 5 through 7, showing the various use positions of the invention.

While the invention is shown in connection with a radial arm saw, it is understood that it may suitably guard devices other than rotating members.

It is to be understood that the form of the invention herewith shown and described is to be taken as a preferred example of the same for disclosure, and that various changes in the shape, size and arrangement of parts may be resorted to, without departing from the spirit of the invention or scope of the subjoined claims.

I claim:

1. A guard for a radial arm saw or the like comprising a mounting bracket, means adjustably attaching the mounting bracket to an existing upper guard or to a member moving with the upper guard on a radial arm saw whereby the mounting bracket can be vertically adjusted relative to said upper guard, an awareness guard in the form of a perimeter member projecting forwardly of and beyond opposite sides of the saw blade of a radial arm saw, the area encompassed by said perimeter member formed substantially or material through which an object being sawed can be visually observed by a sawyer, a bracket carrying the awareness guard and being pivotally attached to the mounting bracket, whereby the awareness guard may be tilted relative to the mounting bracket and also raised and lowered bodily therewith, and a tilt shield secured to the awareness guard and movable therewith and serving to cover a gap which develops when the awareness guard is tilted relative to said upper guard thereby protecting a sawyer from contact with a saw blade at said gap.

2. A guard for a radial arm saw as defined in claim 1, and an integral shield extension on said mounting bracket extending around the forward edge of the saw blade and covering a gap which develops below the upper guard when the mounting bracket and said awareness guard are adjusted downwardly from the upper guard.

3. A guard for a radial arm saw as defined in claim 2, and said integral shield extension being a substantially horizontal U-shaped extension on the mounting bracket near its lower end and forward side.

4. A guard for a radial arm saw as defined in claim 1, and said mounting bracket including a vertical plate portion adjacent one side of said upper guard and being slotted to allow attaching the awareness guard at a predetermined fixed height above a cutting surface.

5. A guard for a radial arm saw as defined in claim 1, and said mounting bracket having a vertical plate portion adjacent to one side of said existing upper guard and said plate portion having a substantially vertical adjustment slot, and cooperating clamping means engaged with said adjustment slot, whereby the mounting bracket and awareness guard may be vertically adjusted and secured releasably in selected adjusted positions.

6. A guard for a radial arm saw as defined in claim 5, and said clamping means comprising a pair of threaded studs on said existing upper guard projecting through said slot, and clamping nuts on said studs engaging on face of said vertical plate portion.

7. A guard for a radial arm saw as defined in claim 1, and said bracket carrying the awareness guard being directly attached to the top of the awareness guard and having an arcuate adjustment slot, another bracket attached directly to said mounting bracket and being pivotally secured to the last-named bracket on a pivotal axis concentric with said arcuate slot, and means to releasably secure said brackets in selected angularly adjusted positions within the limits of the arcuate slot.

8. A guard for a radial arm saw as defined in claim 7, and said last-named means comprising a threaded stud on said bracket attached directly to the mounting bracket projecting through the arcuate slot, and a clamping nut on said stud engaging a wall of said bracket carrying the awareness guard.

9. A guard for a radial arm saw as defined in claim 1, and said tilt shield having a mounting flange attached directly to the top of the awareness guard and having a frontal wall which laps an integral shield extension at the front of the mounting bracket when the awareness guard is substantially level, said frontal wall serving to close a gap ahead of the saw blade and below said upper guard when said awareness guard is tilted.

10. A guard for a radial arm saw as defined in claim 9, and said frontal wall having a diagonal upper edge adapted for parallelism with the lower edge of said upper guard when said awareness guard is in a fully tilted position.

11. A guard for a radial arm saw as defined in claim 1, and said area encompassed by said perimeter member formed substantially entirely from transparent material.

12. A guard for a radial arm saw as defined in claim 11, and said area encompassed by the perimeter member embodied in a transparent plate.

* * * * *